US005275257A

United States Patent [19]

Robertson

[11] Patent Number: 5,275,257

[45] Date of Patent: Jan. 4, 1994

[54] PORTABLE NATURE STAND

[76] Inventor: H. Eugene Robertson, Thomson, Ga.

[21] Appl. No.: 217

[22] Filed: Jan. 4, 1993

[51] Int. Cl.[5] ..... E06C 1/10

[52] U.S. Cl. ..... 182/116; 182/187

[58] Field of Search ..... 182/187, 188, 116, 92, 182/20; 108/52

[56] References Cited

U.S. PATENT DOCUMENTS

| | | | |
|---|---|---|---|
| 1,013,751 | 1/1912 | Dougherty . | |
| 3,220,766 | 11/1965 | Kates . | |
| 3,419,108 | 12/1968 | Mobbs | 182/187 |
| 4,061,202 | 12/1977 | Campbell | 182/187 Y |
| 4,257,490 | 3/1981 | Bandy . | |
| 4,552,246 | 11/1985 | Thomas . | |
| 4,730,699 | 3/1988 | Threlkeld . | |
| 4,742,888 | 5/1988 | Amacker . | |
| 4,787,476 | 11/1988 | Lee . | |
| 5,040,635 | 8/1991 | Strickland | 182/100 |
| 5,105,910 | 4/1992 | Engstrom | 182/187 |

FOREIGN PATENT DOCUMENTS

| | | | |
|---|---|---|---|
| 25635 | 6/1905 | Austria | 182/116 |

*Primary Examiner*—Alvin C. Chin-Shue

*Attorney, Agent, or Firm*—Watson, Cole, Grindle & Watson

[57] ABSTRACT

A portable nature stand having a seat which can be turned through three hundred and sixty degrees, a platform, and one or more ladder sections connected to and extending downwardly from the platform at an acute angle to the upper surface of the platform.

20 Claims, 3 Drawing Sheets 70
60
22
102
116
82
62
110
106
90
172
158
162
156
20
24
8
140
8
130
130

70
60
22
84
82
90
20
172
158
156
140
140
140
130

28
30
32
70
60
22
36
26
140'
140"
140'''
34
140
140
140
140
24
140
140
140
130

70
72
60
44
50
118
102
116
40
10
66
48
64
62
110
10
84
82
80
94
90
124
184

60
66
62
118
110
116
20
A
200
202
80
82
94
90
96
120
122
126
124
176
174
184
188
186
180
136
36
B
24
140
146
142
144
9

PORTABLE NATURE STAND

BACKGROUND OF THE INVENTION

The present invention relates to a portable nature stand, and more particularly to a stand of the type which can be transported into an area such as a forest having many trees and which can be easily mounted in operative position so as to provide a safe and comfortable vantage point from which to observe nature. Such stands are used by photographers or hunters and are often referred to as a deer stand or tree stand.

Stands of this type can, of course, also be employed with upright wooden poles or the like, but the most common use is with trees having a diameter on the order of five inches or more. The stand should be of lightweight construction and be capable of being readily assembled and disassembled without the use of any tools. Nature stands are utilized with trees of many different sizes and configurations. Prior art stands have the disadvantage that they often are not suitable for use with trees having unusual shapes and trees that have many low branches or divided trunks. Furthermore, prior art stands make undesired noises or may have components thereof damaged upon movement of the associated tree caused by wind. It is therefore desirable to eliminate any undesired noises and possible damage to the stand irrespective of movement of the tree to which it is attached.

SUMMARY OF THE INVENTION

The invention stand is made entirely of aluminum to provide maximum strength with minimum weight, thereby enabling the entire stand to be carried by a single person. The components of the stand can be disposed in a compact carrying mode arrangement and then readily assembled and connected to a tree when desired. Assembly and disassembly of the stand can be done manually without the necessity of employing tools of any kind.

The stand includes seat means which can turn through three-hundred and sixty degrees of movement, and means is provided to adjust the vertical height of the seat means. The stand includes a platform means upon which a person can stand; and one or more ladder sections are connected to the platform means and extend downwardly to the ground from the lower part of a tree-engaging edge portion of the platform means at an acute angle to the upper surface of the platform means. A plurality of ladder sections which can be detachably interconnected with one another are provided for mounting the platform means at various heights. This novel construction of the platform means and the manner in which the ladder sections are connected therewith enable the stand to be effectively used with trees of of many different sizes and configurations including trees with many low branches and divided trunks.

The ladder sections are telescopically engaged with one another and are connected together by suitable bolts. The base portion of the lowermost ladder section is provided with stabilizing prong means embedded in the ground to keep the ladder sections from twisting as a person initially climbs the ladder sections to secure the stand to a tree.

In the preferred embodiment, three ladder sections are provided so that the platform means may be supported at three different heights. The platform means is secured to a tree by a flexible chain extending around and engaging the tree. In addition, spikes formed on the tree-engaging edge portion of the platform means are adapted to be embedded in a tree to hold the platform means in place. These spikes have chisel-like tips thereon which will prevent undesired noise from being generated when an associated tree is moved to and fro by wind.

Removable steps are proved on opposite sides of the ladder sections and staggered vertically with respect to one another. When the stand includes two or more ladder sections, a first double step is formed at the lower part of the uppermost ladder section, a second double step is formed at the joint between the uppermost ladder section and the ladder section immediately therebelow, and a third double step is formed at the top of the last-mentioned ladder section. These double steps enable a person to stand in a balanced position when installing the chain around the tree to secure the stand in position. An auxiliary step is provided a suitable distance below the platform means which allows a person to easily climb onto the platform means. This step extends in a direction generally perpendicular to the direction of the removable steps.

When two or more ladder sections are employed, stabilizer means and a movable interconnection between the lower end of a depending portion of the platform means and the upper end of the uppermost ladder section ensure that the stand will operate properly and will not be damaged by movement of the tree by wind. This arrangement ensures that the tree and the platform means secured thereto can move independently of the ladder sections.

The stabilizer means is engageable with an associated tree and is adjustably supported by a depending portion of the the platform means. The stabilizer means is used to swing the platform means upwardly to take the load off of the movable interconnection which can then function in its intended manner to permit relative movement can then function in its intended manner to permit relative movement of the tree and platform means with respect to the ladder sections The movable interconnection includes a bolt extending through an elongated slot formed in the uppermost ladder section thereby forming a lost-motion connection to effect the desired end result.

DESCRIPTION OF THE PREFERRED EMBODIMENT

Figure 1:
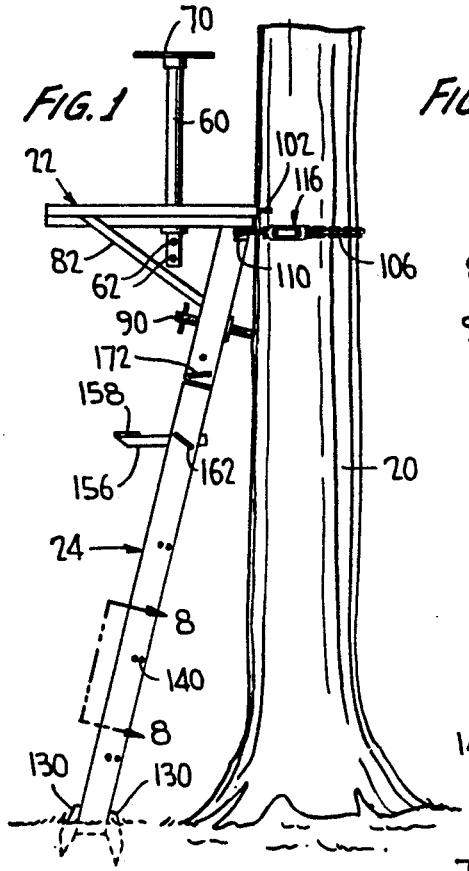
FIG. 1 is a side view of the nature stand employing only one ladder section and secured in operative position on a tree.
Figure 2:
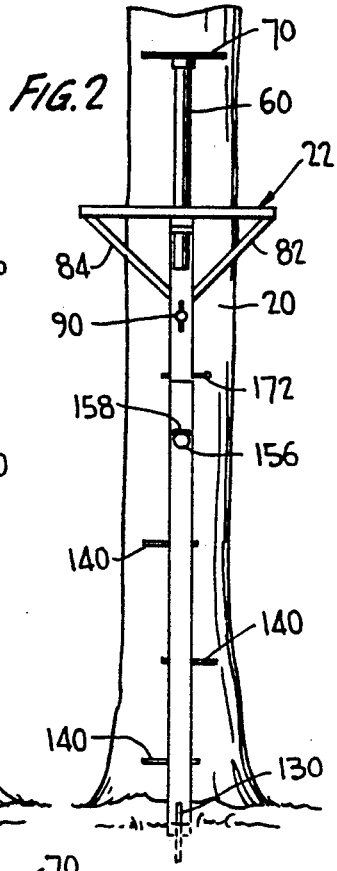
FIG. 2 is a front view of the structure shown in FIG. 1.
Figure 3:
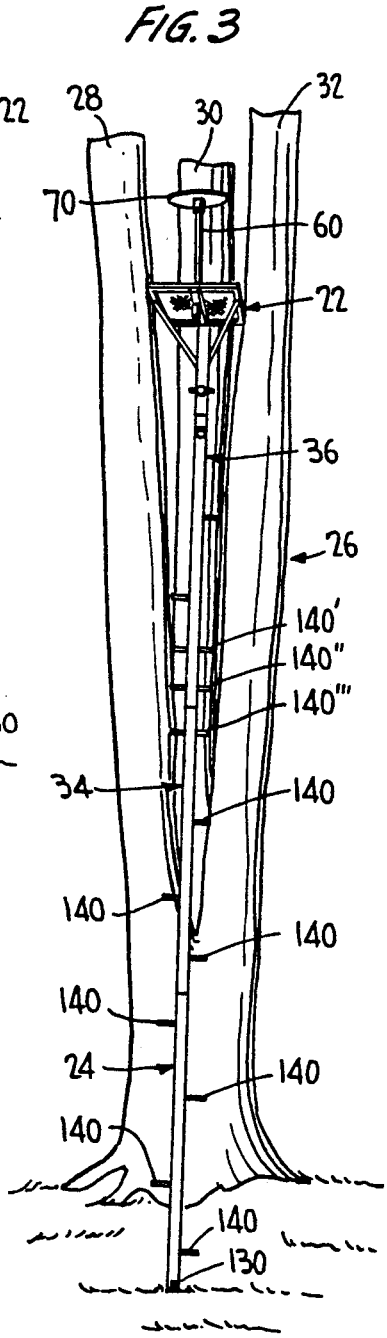
FIG. 3 is a view of the nature stand employing three ladder sections and secured in operative position on a tree having a divided trunk.
Figure 4:
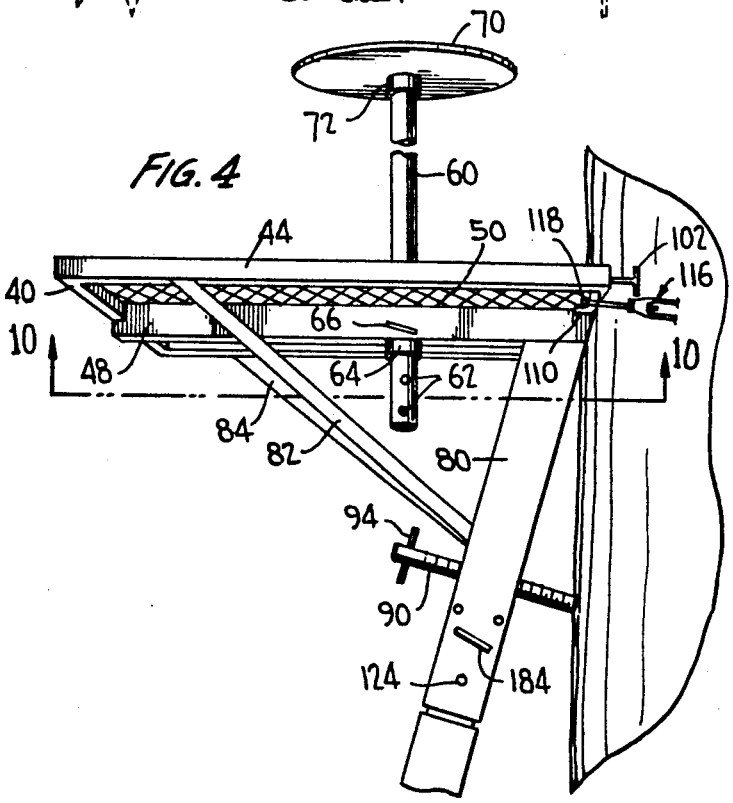
FIG. 4 is an enlarged lower perspective view showing the details of construction of the platform means.

Referring now to FIGS. 1 and 2, a tree includes a trunk 20 to which the portable nature stand is secured. The stand includes a platform means indicated generally by reference numeral 22 and a single ladder section 24 which is detachably connected to the ladder means and which has a base part adapted to engage the ground. Referring now to FIG. 3, a tree 26 includes a trunk divided into three sections 28, 30 and 32 which are separated from one another in a random fashion. The stand includes the same platform means 22 and the ladder section 24 engages the ground. An intermediate ladder section 34 and an uppermost ladder section 36 are also provided, these ladder sections being detachably connected to one another as explained hereinafter. The uppermost ladder section 36 has a movable interconnection with the platform means as later described.

Referring to FIGS. 1, 2, 4 and 10, the platform means includes an outer frame formed of front and rear members 40 and 42 respectively, joined at their opposite ends by side members 44 and 46. A central reinforcing frame member 48 extends between the central portions of members 40 and 42. All of the frame members are formed of tubular aluminum and have a rectangular cross-sectional configuration, these members all being welded together to provide great strength to the frame. An expanded metal deck 50 is also formed of aluminum and is welded to upper portions of the frame members discussed above. Deck 50 defines an upper surface of the platform means upon which a person can stand.

Figure 10:
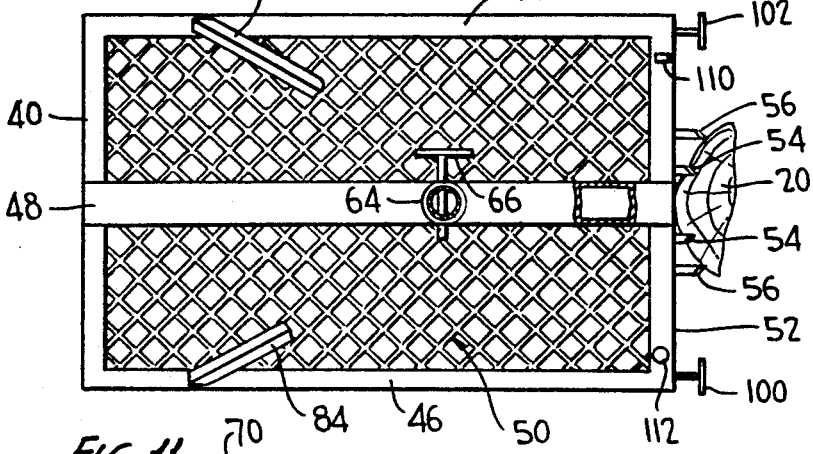
FIG. 10 is a bottom view taken along line 10—10 of FIG. 4.

As seen in FIG. 10, the platform means includes a tree-engaging edge portion 52 from which extends a first pair of spikes 54 and a second pair of spikes 56. Each of these spikes has a sharpened chisel-like tip thereon The pair of spikes 56 is disposed on opposite sides of the pair of spikes 54, spikes 56 being longer than spikes 54. The spikes are adapted to be embedded in an associated tree when the stand is secured to the tree. Spikes 54 are used for trees of about four to eight inches in diameter, and spikes 56 are used for trees of more than eight inches in diameter The chisel-type tips of the spikes will ensure that the platform means is secured to the tree and that there will be no undesired noise upon movement of the tree or upon movement of a person on the stand.

A seat means is mounted on the platform means and includes a vertical supporting post 60 formed of aluminum and comprising a hollow cylindrical member having a plurality of holes 62 formed through diametrically opposite portions of the post at the lower end thereof. Frame member 48 has a suitable hole formed therethrough which slidably receives the post. A collar 64 formed of aluminum is welded to the under surface of frame member 48 and has a hole formed therethrough slidably receiving and guiding movement of post 60. Opposite vertical walls of frame member 48 have holes formed therethrough for receiving a T-bolt 66 which passes freely through the hole in one of said vertical walls, thence through holes in diametrically opposite portions of post 60, the outer end of the T-bolt having threads thereon and being threaded into a threaded hole in the other of said vertical walls. This arrangement retains the seat means in a particular desired vertical position. All of the T-bolts employed in the invention are formed of aluminum and have threads formed on the outer ends thereof.

The seat means includes a circular seat member 70 formed of aluminum upon which a person sits. A depending cylindrical portion 72 formed of aluminum is welded to the undersurface of member 70 and has internal threads thereon which engage the threads formed on the upper end of post 60. With this construction, the seat may turn through an angle of 360 degrees so that a person may view all of the surrounding area.

The platform means includes a depending portion 80 formed of aluminum and being of tubular construction of rectangular cross-sectional configuration. The upper end of portion 80 is welded to frame member 48 and extends downwardly from the lower portion of the platform means adjacent the tree engaging edge portion 52 at an acute angle of about 75 degrees to the upper surface of the platform means as indicated by angle A in FIG. 5. A pair of aluminum bars 82 and 84 each have one end thereof welded to depending portion 80, the opposite ends of the bars being welded to frame members 44 and 46 respectively to rigidly interconnect the platform frame and depending portion so that a person can be supported on the upper surface of the platform which will lie generally in a horizontal plane.

Figures 5, 6, 7, 8, 9:
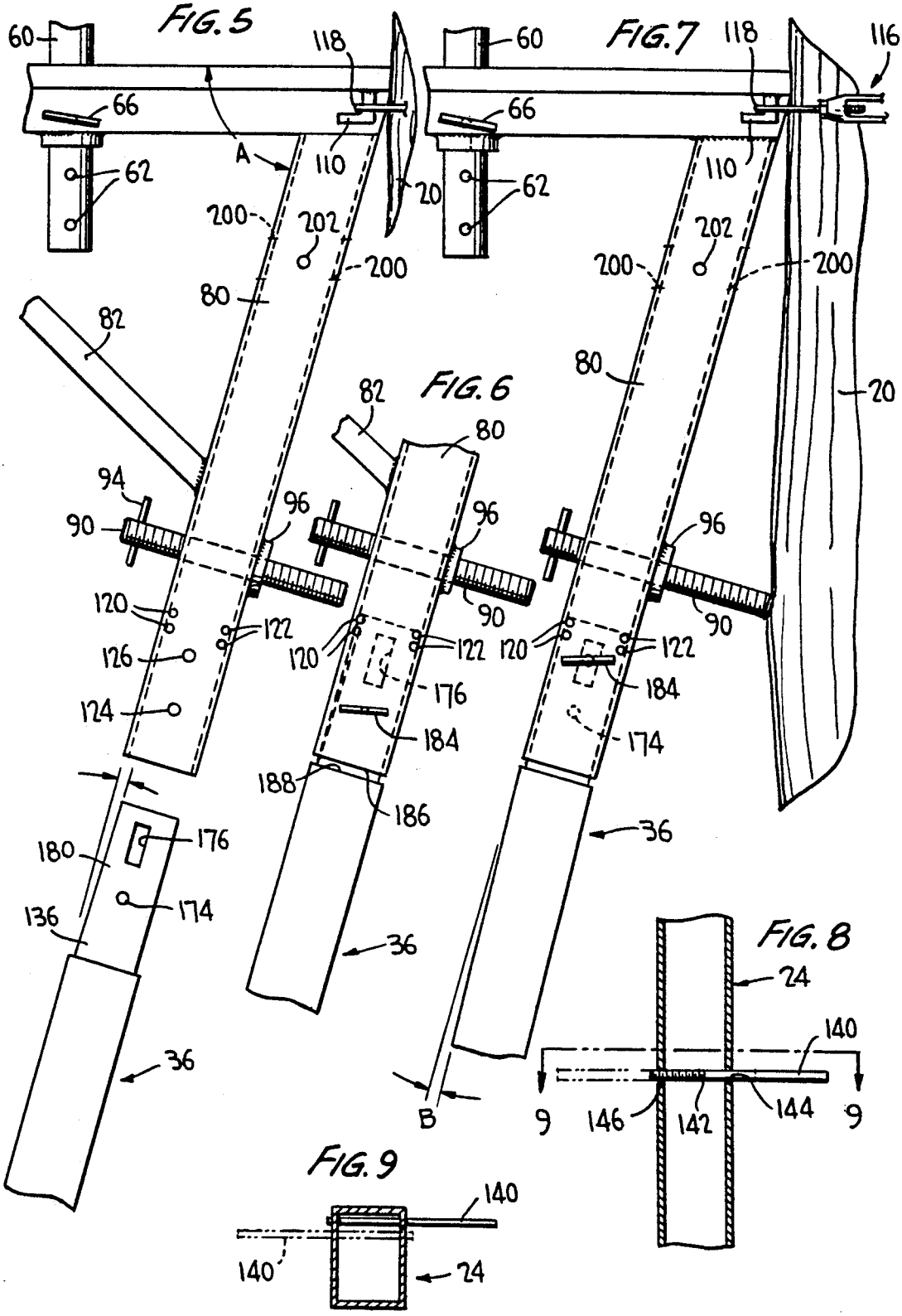
FIG. 5 is an exploded view of the depending portion of the platform means and the upper end of the uppermost ladder section.
FIG. 6 is a view showing the movable interconnection in a first position.
FIG. 7 is a view showing the movable interconnection in a second position.
FIG. 8 is an enlarged section taken along line 8—8 of FIG. 1.
FIG. 9 is a section taken along line 9—9 of FIG. 8.

As seen in FIG. 5, a stabilizer means comprises an externally threaded aluminum pipe 90 having an inner end 92 adapted to engage the outer surface of a tree. A handle 94 is mounted at the outer end of the pipe to facilitate turning of the pipe. The pipe is threaded into an internally threaded aluminum cylindrical fitting 96 which is disposed within suitable holes formed in opposite walls of depending portion 80 and is welded in place. The use of the stabilizer means is explained hereinafter.

Figure 12:
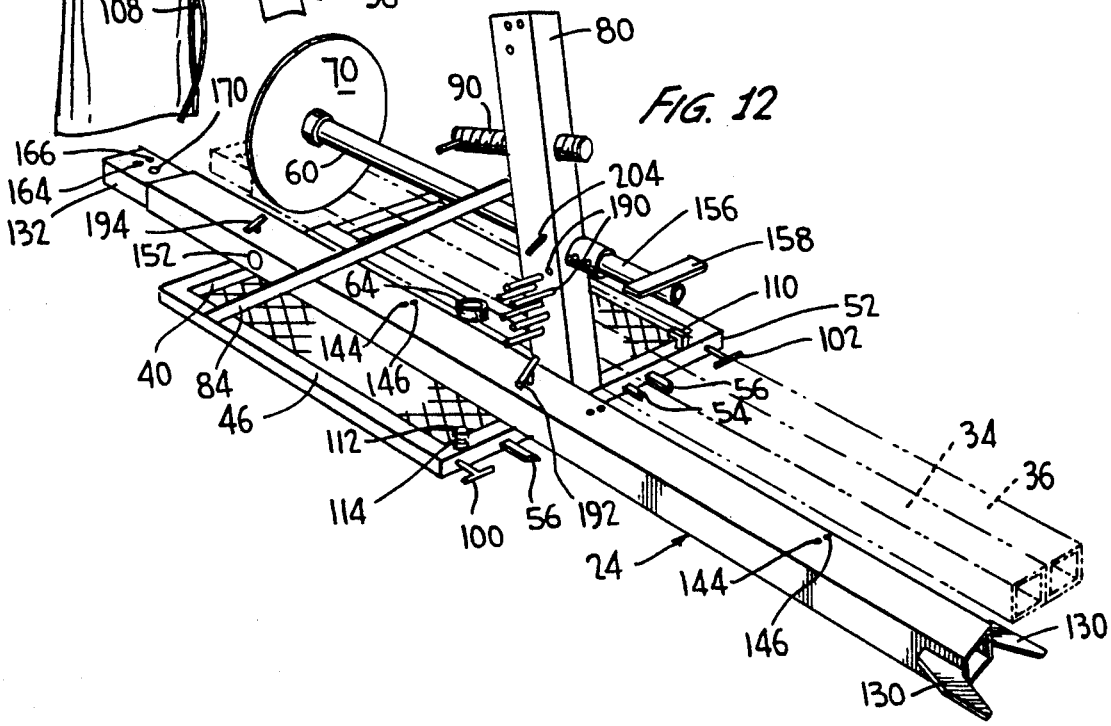
FIG. 12 is a top perspective view showing the stand in the carrying mode.

As seen in FIGS. 10 and 12, a pair of T-bolts 100 and 102 similar to T-bolt 66 are threaded into suitable holes formed at opposite end portions of the tree-engaging edge portion 52 of the platform means. These two T-bolts serve as a safety means when the stand is first set up against a tree and a person climbs up the stand to secure it to the tree. If the stand is not properly centered on the trunk of the tree, there may be a tendency for the platform means to slide laterally off the tree. T-bolts 100 and 102 will engage the tree if the stand starts to slide laterally and serves to limit such sliding movement, thereby preventing the stand from falling to the ground and possibly injuring a person climbing the stand.

Figure 11:
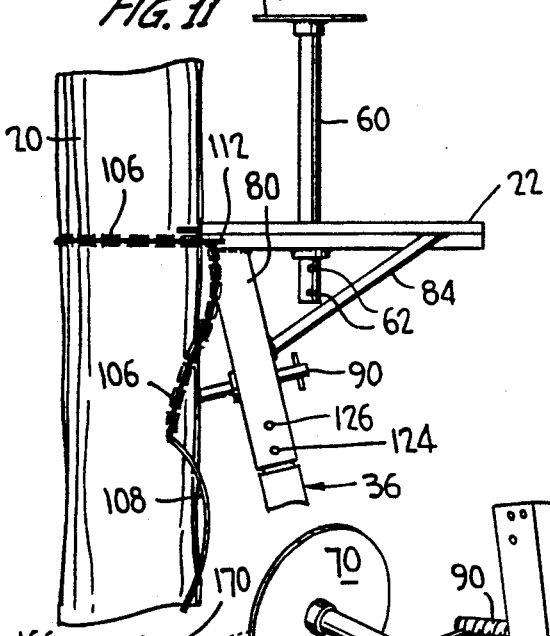
FIG. 11 is a side view of the platform means from the side opposite to that shown in FIG. 1.

In order to secure the platform means to a tree, securing means includes a conventional flexible link chain 106 having a length of stiff wire 108 connected to one end thereof as seen in FIG. 11. This stiff wire has a length of about two feet and is used to thread the chain around the tree when the platform is initially mounted in position. In order to secure the chain to the platform means, an aluminum hook 110 is welded to the undersurface of frame member 42 adjacent one end thereof, and an aluminum stud 112 having a peripheral groove 114 formed therein is welded to the undersurface of frame member 42 adjacent the opposite end thereof. A conventional turnbuckle device 116 is connected to an end of the chain to tighten the chain in operative position.

After the stand is initially set up against a tree, a person attaches the turnbuckle device to hook 110, the turnbuckle device having a hook 118 thereon to cooperate with hook 110. The chain is then passed around the tree using wire 108, and one link of the chain is placed over stud 112 with the chain link disposed in the peripheral groove in the stud. The turnbuckle is then tightened in the usual manner to secure the platform means to the tree with the spikes on the platform means embedded in the tree to that there will be substantially no relative movement between the platform means and the tree.

As seen in FIG. 5, the lower end of the depending portion 80 of the platform means includes a first pair of peep holes 120 formed through opposite sides thereof; and a second pair of peep holes 122 is also formed through opposite sides thereof Additionally, two pairs of spaced holes 124 and 126 are formed through opposite sides of the depending portion. The purpose and function of these various holes in the lower end of the depending portion is defined hereinafter.

All of the ladder sections are formed of tubular aluminum of rectangular cross-sectional configuration, and as seen in FIGS. 1 and 12, the lowermost ladder section 24 has a pair of aluminum prongs 130 secured to opposite sides thereof by welding. These prongs are adapted to be embedded in the ground when the stand is set up against a tree and serve to prevent twisting of the ladder sections of the stand as a person climbs up on the stand. Each of the ladder sections has a tubular aluminum portion at the upper end thereof of less outer dimension so that it is adapted to slide into the hollow lower end of the ladder section thereabove or into the depending portion 80. The upper end portion 132 of ladder section 24 is adapted to telescope into the lower end of the depending portion as shown in FIGS. 1 and 2 or into the lower end portion of one of the other ladder sections as shown in FIG. 3; this is dependent on whether a single ladder section is used or more than one ladder section is used. The upper end portion 134 of ladder section 34 is adapted to telescope into the lower end of ladder section 36; and the upper end portion 136 of ladder section 36 is adapted to telescope into the lower end of the depending portion of the platform means.

A single ladder section 24 can be used as shown in FIG. 1 so that the upper surface of the platform means is supported about six feet six inches above the ground. Ladder sections 24 and 36 can be used together so that the upper surface of the platform means is supported about eleven feet three inches above the ground. When all three ladder sections are used as shown in FIG. 3, the upper surface of the platform means is supported about 16 feet above the ground.

As seen in FIGS. 8 and 9 steps 140 are formed of solid rods of aluminum having a circular cross-sectional configuration and having a threaded outer surface 142 formed on the outer end thereof. All of the ladder sections are provided with suitable holes for mounting the steps in position. A series of holes are provided including an enlarged hole 144 formed in one side of each ladder section and an opposite smaller threaded hole 146 formed on the opposite side of the ladder section so that a step can be inserted through the larger hole and threaded into the smaller hole opposite thereto to mount the step. Each pair of holes 124 and 126 also include an enlarged hole formed in one side of the depending portion and a smaller threaded hole formed in the opposite side of the depending portion for receiving a T-bolt.

A large hole and a small hole are disposed adjacent one another on each side of the ladder section as seen most clearly in FIGS. 1 and 12 so that a step can be mounted either on one side or the other side of the ladder section at any location, and further so that a double step extending on both sides of the ladder may be mounted at substantially the same height on the ladder section. A double step arrangement is shown in phantom line in FIGS. 8 and 9 and the double step arrangement in the assembled stand is clearly shown in FIG. 3 of the drawing wherein the double steps have been given the reference numerals 140', 140'' and 140'''.

It should be understood that each of the three ladder sections is provided with suitable holes 144 and 146 in the opposite sides thereof along the length thereof to support steps in desired positions which generally alternate at opposite sides of the ladder sections except where double steps are provided. Additionally, the reduced tubular ends of the ladder sections are also provided with similar hoes in the opposite sides thereof to mount steps at the joint between ladder sections. The lower open end portions of ladder sections 34 and 36 are provided with similar openings aligned with the openings of the portions which telescope into these lower open end portions so that T-bolts may be inserted to interconnect the joints, or so that steps can be inserted which will also interconnect the joints dependent on the location of the telescoping interconnection on the stand. All of the T-bolts in the invention are mounted by passing them through an enlarged hole on side of the associated member and threading them into a smaller threaded hole on the opposite side of the associated member.

As seen in FIG. 1, an auxiliary step 150 is provided which can be used by a person to climb onto the platform means. This auxiliary step is supported by the ladder section immediately below the depending portion of the platform means at a distance which is convenient for an average sized person to move directly from the auxiliary step to the upper surface of the platform means. As seen in FIG. 12, ladder section 24 is provided with a hole 152 in one side thereof, a similar hole being provided in the opposite side thereof, these holes being disposed such that when the stand is in operative position, the step will be disposed substantially horizontally to support the feet of a person climbing the stand.

The auxiliary step includes a tubular aluminum member 156 having a flat aluminum bar 158 welded to the outer end thereof. A person steps on this bar when using the auxiliary step. Member 156 has a pair of diametrically opposite holes formed therethrough which are adapted to be aligned with suitable holes formed in opposite sides of ladder section 24. An enlarged hole 160 is seen in FIG. 12, a smaller threaded hole being formed in the opposite side of the ladder section. As seen in FIG. 1, a T-bolt 162 passes through hole 160 and the aligned holes in member 156 and is threaded into the smaller threaded hole to support eh auxiliary step in operative position. It should be understood that ladder sections 34 and 36 are also provided with holes similar to 152 to support the auxiliary step in operative position thereon when two or three ladder sections are employed.

As seen in FIG. 12, the upper end 132 of ladder section 24 has a pair of holes 164 and 166 formed on opposite sides thereof for receiving steps mounted at the joint with other ladder sections. A pair of further holes 170 are formed through opposite sides of the upper end for receiving a T-bolt 172 as shown in FIG. 1 to secure the upper end to the depending portion 80, such T-bolt being disposed in holes 124 of the depending portion. When only the ladder section 24 is used as shown in FIGS. 1 and 2, this arrangement is satisfactory.

However, when two or more ladder sections are employed it is necessary to employ a movable connection as illustrated in FIGS. 5–7 which permits the ladder sections to move independently of the tree and platform means secured thereto. The upper end portion 136 of ladder section 36 is provided with a pair of aligned holes 174 disposed through opposite sides thereof. End portion 136 also has a pair of aligned elongated longitudinally extending slots 176 formed through opposite sides thereof for slidably receiving a T-bolt therethrough to provide a lost-motion interconnection so that ladder section 36 will be able to move within certain limits with respect to the depending portion 80 of the platform means.

As seen in FIG. 5, upper portion 136 has a tapered side edge 180 so that the upper end portion becomes smaller toward the upper extremity thereof to permit the upper end to telescope within the open lower end of the depending portion of the platform means and also to be slightly misaligned relative to the depending portion. This taper may be on the order of about 3/16 inch over a longitudinal distance of about five inches.

When assembling the stand with more than one ladder section, ladder section 36 is telescopically inserted within the open lower end of depending portion 80 of the platform means, and a T-bolt 184 is inserted through hole 124 at one side of the depending portion, thence through holes 174 in ladder section 36 and then threaded into the threaded hole 124 at the opposite side of the depending portion. This arrangement serves to connect ladder section 36 to depending portion 80 with a space of about ⅜ inch between the lower edge 186 of depending portion 80 and the shoulder 188 on the ladder section between the main body of the ladder section and the upper portion 136 thereof as seen in FIG. 6. In this position, ladder section 36 is longitudinally aligned with the depending portion 80.

The platform means is then set up against a tree and the base of the lowermost ladder section 24 is moved to level the platform so that the upper surface thereof is substantially horizontal. The prongs 130 of ladder section 24 are embedded in the ground to secure the base of the ladder to the ground. A person then ascends the steps at opposite sides of the ladder until he reaches a suitable double step and then secures the platform means to the tree by means of the chain.

T-bolt 184 is then removed and inserted through hole 126 at one side of the depending portion, thence through the mid portion of the slot 176 and then threaded into the threaded hole 126 at the opposite side of the depending portion. The stabilizer means is then used by turning handle 94 in a direction to push the platform means away from the tree, taking the spring out of the ladder and taking the load off of the joint between the platform means and ladder section 36. The tapered edge 180 then permits the ladder section 36 to be slightly misaligned relative to the depending portion 80 under the influence of gravity to form the angle B in the position shown in FIG. 7.

The use of the peepholes 120 and 122 will now be described. When the components are properly disposed in the position shown in FIG. 6, daylight will be visible through peep holes 120, while no daylight will be visible through peep holes 122. When the components are properly disposed in the position shown in FIG. 7, less daylight will be visible through peep holes 120, and daylight will be visible through peep holes 122. Accordingly, peep holes 120 and 122 serve as a means for checking that the components are in the proper operative positions.

It is apparent that since T-bolt 184 passes through the center of slot 176 in the position shown in FIG. 7, the T-bolt serves as a retaining member securing the ladder to the platform means, but permitting relative movement of the tree and platform means relative to the ladder so that movements of the tree by wind will not damage the structure of the stand.

Referring now to FIG. 12 of the drawing, the carrying mode of the invention is illustrated wherein the various components of the device are interconnected with one another. It will be noted that the platform means is upside down and that a number of threaded holes 190 are provided in one side of the depending portion within which all of the steps can be threaded and carried during transport.

The number of ladder sections carried will depend on the height at which a person wishes to be supported. Ladder section 24 is illustrated as being carried by the platform means. Suitable holes are provided through opposite sides of the ladder section to receive T-bolts 192 and 194 which pass through the holes in the ladder section and are threaded into suitable threaded holes provided in the undersurface of platform members 42 and 40 respectively. Ladder sections 34 and 36 are indicated in phantom lines, and may be carried in a similar manner on the platform means by a pair of T-bolts passing through holes in the ladder sections and being threaded into suitable holes (not shown) in the undersurface of platform members 42 and 40.

In the carrying mode, post 60 of the seat means extends through aligned holes 200 formed in opposite sides of the depending portion 80 as seen in FIG. 5. A pair of holes 202 are formed through the other opposite sides of the depending portion. A T-bolt 204 as seen in FIG. 12 extends through an enlarged hole 202 at one side of the depending portion and thence through one of the holes 62 formed through post 60 and is threaded into a smaller threaded hole 202 at the opposite side of the depending portion to hold the seat means in position. The chain is carried in the hollow interior of the post, and the tubular portion 156 of the auxiliary step is dimensioned to telescope within the open end of the post. Accordingly, the auxiliary step is carried by the post, and T-bolt 204 also passes through the holes formed in tubular portion 156 to retain the auxiliary step in the carrying position shown.

It is apparent that after arriving at a suitable location, the components shown in FIG. 12 can be readily manually disassembled and connected to provide an erected nature stand without the use of any tools.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A portable nature stand comprising platform means for supporting a person, said platform means including an upper surface, and a lower portion, securing means for engaging a tree and securing the platform means to a tree, said platform means including a depending portion extending downwardly from said lower portion, said depending portion having a lower end, a ladder section having steps thereon and including an upper end and a lower end, the lower end of said depending portion and the upper end of said ladder section being connected to one another by a lost-motion interconnection so that said ladder section can move within certain limits relative to said depending portion to permit movement of a tree and the platform means relative to said ladder section.

2. A stand as defined in claim 1 including seat means mounted on said platform means for supporting a person on the stand, said seat means including means for mounting said seat means at various vertical heights relative to said upper surface of the platform means.

3. A stand as defined in claim 1 wherein said securing means comprises a flexible chain, means for tightening said chain about a tree, and an elongated relatively rigid member secured to said chain to facilitate passing the chain around a tree.

4. A stand as defined in claim 1 wherein said securing means includes a plurality of spikes extending from said tree engaging edge portion of the platform means and adapted to be embedded in a tree when the stand is in operative position, said spikes having sharpened chisel-like tips thereon.

5. A stand as defined in claim 4 wherein said spikes include a first pair of spikes and a second pair of spikes disposed on opposite sides of said first pair of spikes, said second pair of spikes being longer than said first pair of spikes.

6. A stand as defined in claim 1 including an auxiliary step supported by said ladder section and extending in a direction generally perpendicular to the direction of said first-mentioned steps.

7. A portable nature stand comprising platform means for supporting a person, said platform means including an upper surface, a lower portion and a tree-engaging edge portion, securing means for engaging a tree and securing the platform means to a tree, said platform means including a depending portion extending downwardly from said lower portion adjacent said tree engaging edge portion of the platform means and at an acute angle to said upper surface, said depending portion having a lower end, and a ladder section having steps thereon, said ladder section being detachably connected to and generally aligned with said depending portion, said stand including stabilizer means engageable with a tree and being adjustably supported by said depending portion.

8. A stand as defined in claim 7 wherein said lower end of the depending portion is hollow, said ladder section having an upper end telescopically received within said hollow lower end.

9. A stand as defined in claim 8 including a movable interconnection between said lower end of the depending portion and said upper end of the ladder section.

10. A stand as defined in claim 9 wherein said movable interconnection includes a retaining member extending through an elongated slot formed in said upper end of the ladder section.

11. A stand as defined in claim 10 wherein said upper end of the ladder section includes a tapered side surface which permits said ladder section to be slightly misaligned relative to said depending portion.

12. A stand as defined in claim 11 including peep holes formed through said depending portion to determine that said movable interconnection is in proper position.

13. A stand as defined in claim 7 including a plurality of ladder sections each of which has steps thereon and being detachably connected to one another, the uppermost ladder section being detachably connected to said depending portion by a movable interconnection to permit movement of a tree and the platform relative to said uppermost ladder section.

14. A stand as defined in claim 13 wherein the lowermost ladder section has a base portion including stabilizing prong means thereon adapted to be embedded in the ground to stabilize the ladder sections from twisting when a person climbs the ladder sections to secure the stand to a tree.

15. A portable nature stand comprising platform means for supporting a person, said platform means including an upper surface, a lower portion and a tree-engaging edge portion, securing means for engaging a tree and securing the platform means to a tree, said platform means including a depending portion extending downwardly from said lower portion adjacent said tree engaging edge portion of the platform means and at an acute angle to said upper surface, said depending portion having a lower end, and a ladder section having steps thereon, said ladder section being detachably connected to and generally aligned with said depending portion, said stand including seat means mounted on said platform, said seat means including a supporting post having a rotatable seat at the upper end thereof, said depending portion having a hole formed therethrough to receive said post when a person is carrying the stand.

16. A portable nature stand comprising platform means for supporting a person, seat means mounted on said platform means for supporting a person on the stand, said platform means including an upper surface, a lower portion and a tree-engaging edge portion, securing means for engaging a tree and securing the platform means to a tree, said platform means including a depending portion extending downwardly from said lower portion at an acute angle to said upper surface, stabilizer means engageable with a tree and being adjustably supported by said depending portion, said depending portion having a lower end, a ladder section having steps thereon and including an upper end and a lower end, said lower end of the depending portion and said upper end having a movable interconnection therebetween to permit movement of tree and the platform relative to said ladder section.

17. A stand as defined in claim 15 wherein said lower end of the depending portion is hollow and has a longitudinal dimension, said upper end of the ladder section being telescopically received within said lower end of the depending portion, said lower end of the depending portion having a hole formed therethrough, said upper end of the ladder section having a slot formed therethrough, a retaining member extending through said hole in said lower end of the depending portion and through said slot in said upper end of the ladder section, a further ladder section having steps thereon being detachably connected to said lower end of the first-mentioned ladder section.

18. A stand as defined in claim 17 wherein said lower end of the depending portion includes a further hole formed therethrough and spaced longitudinally from said first mentioned hole, said upper end of the first-mentioned ladder section having another hole formed therethrough and spaced from said slot, said further hole and said another hole being adapted to be aligned to receive a retaining member therethrough when securing the stand to a tree.

19. A stand as defined in claim 17 wherein said upper end of the first-mentioned ladder portion has a side edge which is tapered so that said upper end of the first-mentioned ladder portion becomes smaller toward the end thereof to thereby permit said first-mentioned ladder portion to be slightly misaligned relative to said depending portion.

20. A stand as defined in claim 19 including first and second peep holes formed through said first-mentioned ladder section and spaced from one another to determine that said movable interconnection is in proper position.

* * * * *